US007931210B1

(12) United States Patent
Pike et al.

(10) Patent No.: US 7,931,210 B1
(45) Date of Patent: Apr. 26, 2011

(54) TIRE TREAD RAILROAD TIE

(76) Inventors: James A. Pike, Fairview, PA (US); William J. Galloway, Greenville, PA (US); Calvin Nichols, Morrisville, NY (US); Lucian Gilbert, Walworth, NY (US)

( * ) Notice: Subject to any disclaimer, the term of this patent is extended or adjusted under 35 U.S.C. 154(b) by 1103 days.

(21) Appl. No.: 11/315,724

(22) Filed: Dec. 22, 2005

(51) Int. Cl.
*E01B 3/00* (2006.01)

(52) U.S. Cl. ..... 238/85

(58) Field of Classification Search ..... 238/29, 238/36, 37, 83, 84, 85
See application file for complete search history.

(56) References Cited

U.S. PATENT DOCUMENTS

| | | | | |
|---|---|---|---|---|
| 5,310,032 | A * | 5/1994 | Plichta | 191/29 DM |
| 5,609,295 | A * | 3/1997 | Richards | 238/84 |
| 6,372,069 | B1 * | 4/2002 | Walls | 156/95 |
| 2005/0156055 | A1 * | 7/2005 | Kenney et al. | 238/84 |

* cited by examiner

*Primary Examiner* — S. Joseph Morano
*Assistant Examiner* — R. J. McCarry, Jr.
(74) *Attorney, Agent, or Firm* — Lando & Anastasi, LLP

(57) ABSTRACT

Re-cycled tire treads are laminated into stacks and attached to a reinforcement element which has a first portion which provides increased compressive strength and a second portion which provides increased torsional and bending strength. Several embodiments with reinforcing elements ranging from T-bars, to I-beams to box beams, with variations including corrugated flanges. Pre-drilled holes can be provided in the flanges to facilitate insertion of the spikes. While steel-belted tires are preferred for use in creating stacks, provisions are made to ensure electrical isolation of the two rails to permit transmission of data thereby. The railroad tie can have electronic signaling hardware built-in by placing sensors and related circuitry between adjacent plies in a laminated stack.

5 Claims, 6 Drawing Sheets

TIRE TREAD RAILROAD TIE

BACKGROUND AND SUMMARY OF THE INVENTION

The present invention is directed to the field of railroad beds. More particularly, the present invention is directed to a railroad tie made of recycled tire treads having adequate compressive strength and torsional stiffness to withstand the loading associated with continuous rail transit.

There are a number of problems associated with conventional wooden rail ties. Continuous rail traffic and weathering causes splitting, allowing spikes to backout, which compromises the integrity of the rail bed. In addition, the creosote with which the wooden ties are treated constitutes an environmental hazard and its use has fallen into disfavor. The discarded ties themselves, once they have been removed from the rail bed, become a form of environmental waste littering the country side or providing a problem for land fills.

Another environmental disposal problem is associated with used automotive tires. Tires cannot be burned due to the resulting air pollution and they are not readily buried in land fills since the minimal bio-degradation which takes place can threaten to pollute surrounding water supplies. Accordingly, tire disposal has become a major environmental problem and most tire retailers impose a tire disposal fee with each tire replaced. It is the intention of the present invention to remedy these two environmental problems by turning the tire disposal problem into a resource material for producing railroad ties which do not require the application of creosote.

Several attempts have been made to manufacture a suitable rail tie from used automotive tires. For example, U.S. Pat. Nos. 6,824,070; 6,708,896; and 6,372,069 teach rail ties utilizing recycled tire treads. In addition, U.S. Pat. No. 5,996,901 has rigid plates laminated to the top and bottom of the stack of tires. However, none of these attempts have succeeded in providing a rail tie which has adequate compressive strength, torsional and bending stiffness to stand up under the rigors imposed by continuous rail traffic.

The present invention overcomes the problems with previous attempts by providing adequate compressive strength, as well as torsional and bending stiffness to withstand the continuous loading of rail traffic without degradation of the tie body or experiencing backout of the retention spikes.

The railroad tie of the present invention comprises an elongated tie which includes a) at least one stack of laminated tire treads forming a body of the tie; b) reinforcing means integrated into the at least one stack of laminated tire treads, the reinforcing means having a first portion providing increased compressive strength and a second portion providing increased torsional and bending stiffness to the elongated tie. More preferably, the at least one stack of laminated tire treads comprises at least two stacks of laminated tire treads, the reinforcing means including a vertical member that extends between the at least two stacks, and most preferably, the reinforcing means comprises an I-beam which has a stack secured into each recess between the flanges.

The reinforcing member is made of a material selected from a group consisting of wood, conductive metals, non-conductive metals and composites. It is preferable that the vertical member extends between the at least two stacks in non-contacting relationship to provide electrical isolation. This can be done by forming a gap which is filled with a non-conducting material. It is also preferred that a distal end of the vertical member be spaced from a lowermost element, the lowermost element forming a bottom surface of the elongated tie. In the preferred embodiment, an additional tire tread ply sandwiches each of the two reinforcing flanges of the I-beam between itself and at least one of the stacks of laminated tire treads.

It has proven advantages for a distal end of each flange of the I-beam to have a transverse flange extending parallel to said vertical member. In an alternative embodiment, the horizontal members of the I-beam are formed as upper and lower box flanges which are each filled with tire treads. Each flange of the I-beam has a group of cut-out portions to accommodate rail securing spikes. In one embodiment the I-beam has a hollow box spine. In yet another embodiment, at least one horizontally extending flange of the reinforcing member is corrugated. In certain embodiments, the laminated stacks of tire treads are made from recycled steel belted tires. In those embodiments, it is particularly important that the tire treads have periodic gaps formed in a length of each laminate layer to ensure electrical isolation between the two supporting rails. This permits signaling/monitoring electrical systems to be installed in the railroad ties of the present invention.

Various other features, characteristics and advantages of the present invention will become apparent after a reading of the following detailed description of the present invention.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
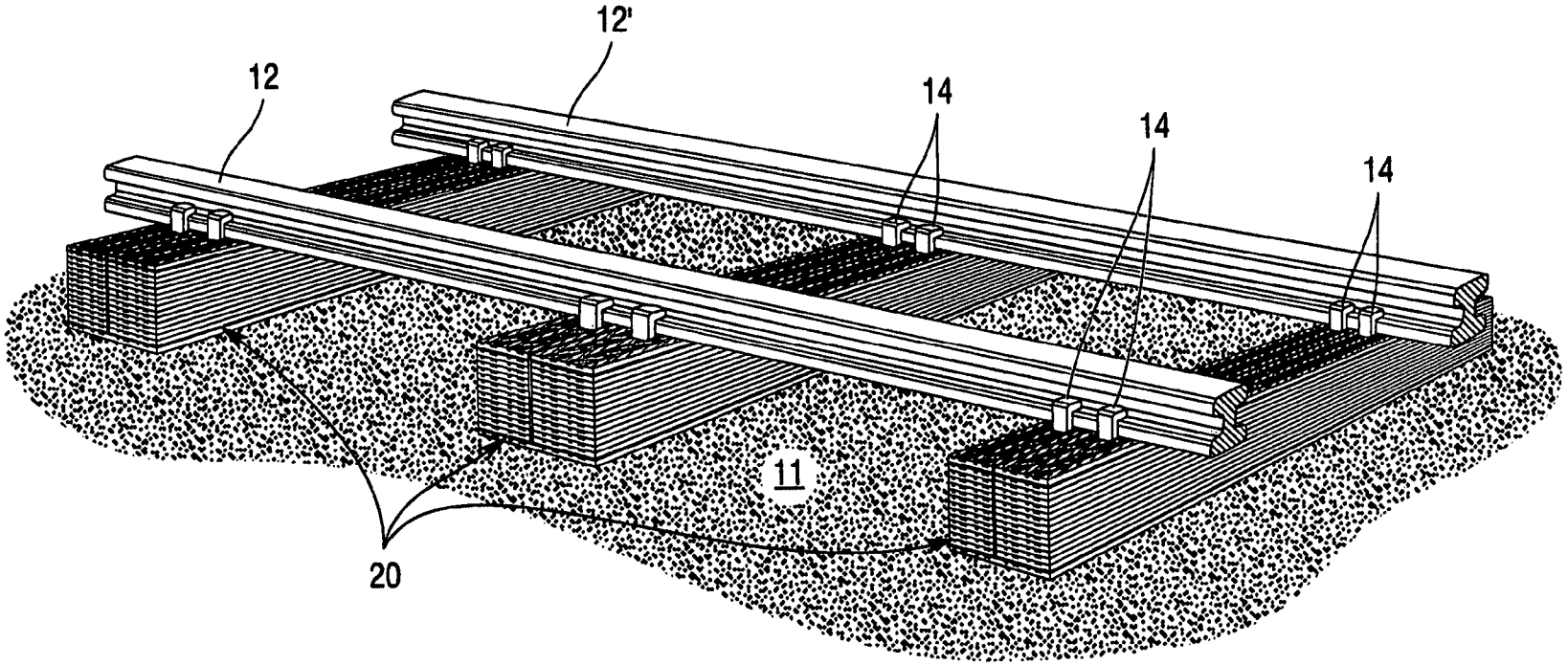
FIG. 1 is a perspective view of a first embodiment of the railroad tie of the present invention shown supporting a pair of parallel support rails.
Figure 2:
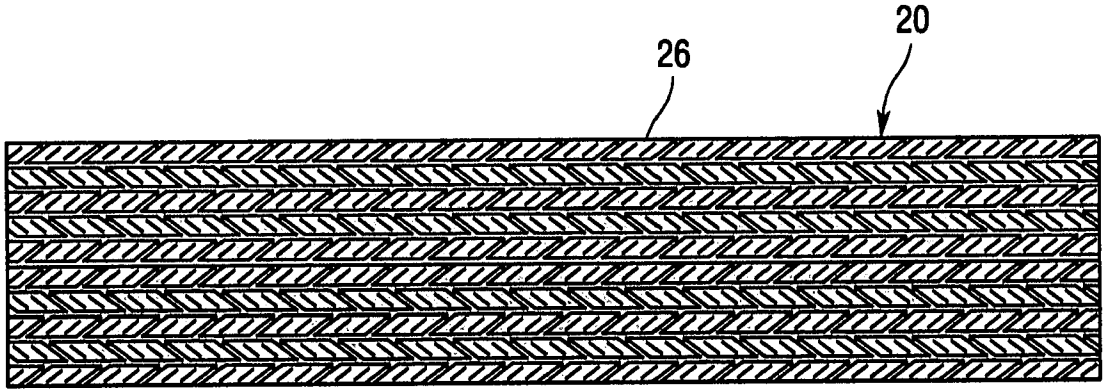
FIG. 2 is a top view of the first embodiment.
Figure 3:
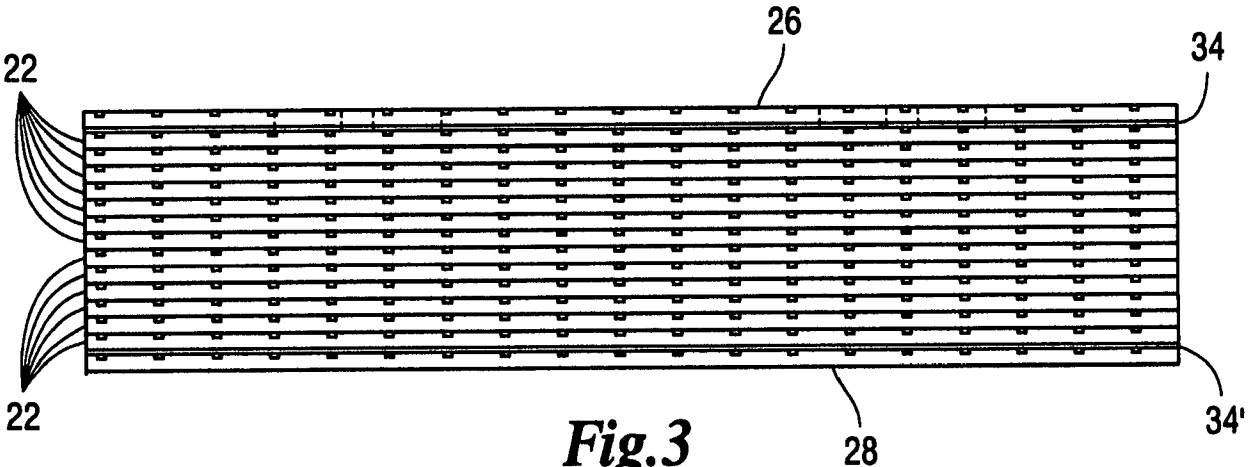
FIG. 3 is a is a side view of the first embodiment.
Figure 4:
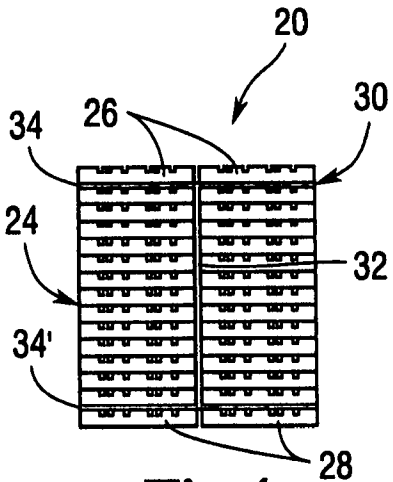
FIG. 4 is an end view of the first embodiment.
Figure 5:
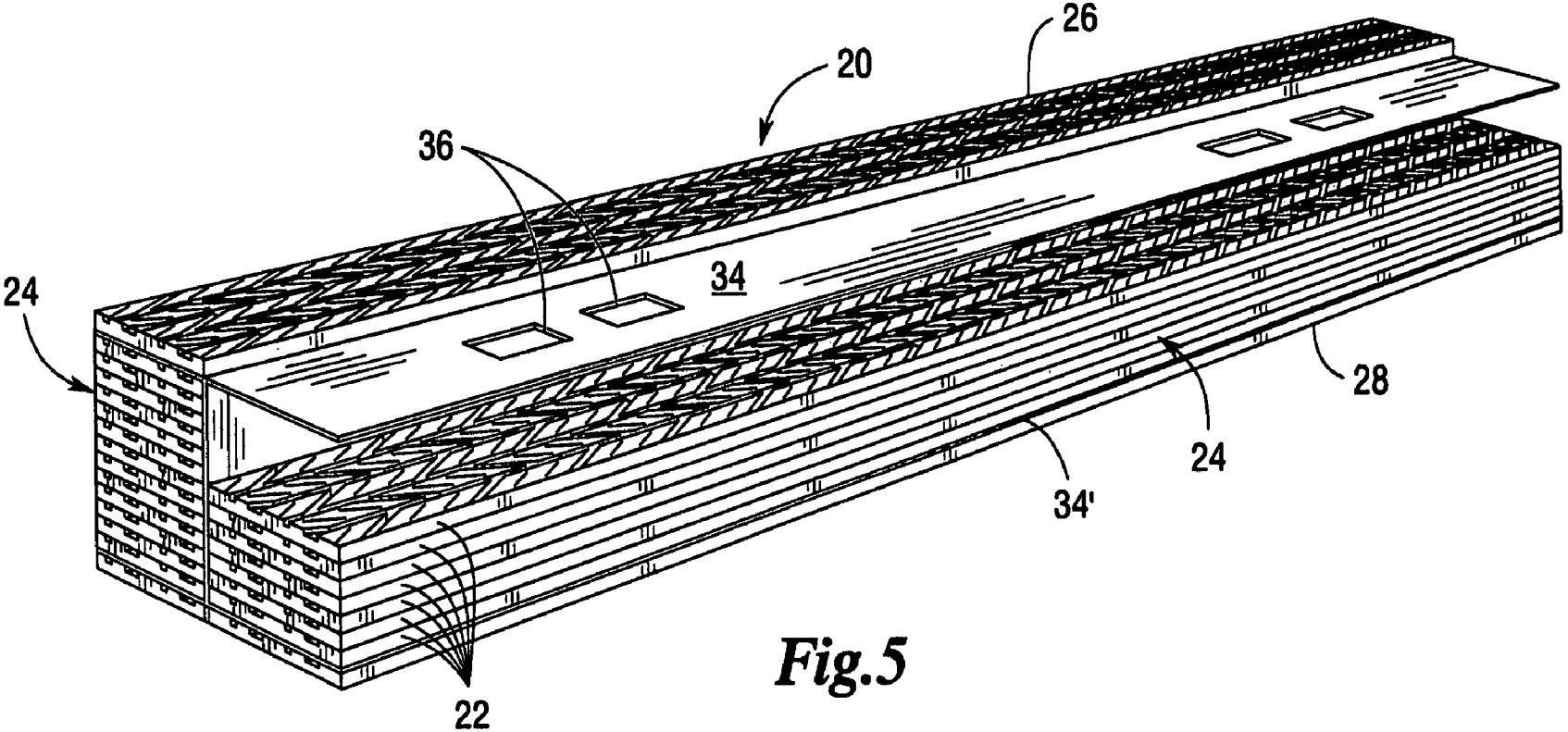
FIG. 5 is an enlarged perspective view showing a partially disassembled tie of the first embodiment.

A first embodiment of the railroad tie of the present invention is shown in FIGS. 1-5 generally at 20. As depicted therein, railroad tie 20 has an elongated, generally rectangular shape. It will be understood that other shapes are possible and within the purview of the present invention, although elongated rectangular ties are conventional and will initially be the preferred configuration. As best seen in FIG. 5, elongated tie 20 is configured as at least one, and more preferably, two stacks 24 of laminated tire treads 22. These treads are preferably recycled tires, most of which are belted and generally, steel belted. Treads 22 are laminated using an adhesive, such as a two-part, rubber-to-rubber epoxy. An upper (26) and lower (28) surface tire tread ply are adhered to each laterally extending face of the stacks 24. As seen in FIG. 1, ties 20 are spaced in conventional fashion on a rail bed ballast 11 to provide a support bed for parallel rails 12, 12'.

Railroad tie 20 has a reinforcing means or spine 30 which has a first vertical portion 32 which increases compressive strength of tie 20 and at least one second horizontal portion 34, 34' which increases torsional and bending stiffness thereof. In this preferred embodiment, flanges 34, 34' sandwich the two stacks 24 of laminated tire treads with the upper and lower capping plies 26, 28 adhered thereto, respectively. The use of capping plies 26, 28 provide a number of important benefits: 1) if the reinforcing means 30 is made of a corrosion-susceptible material, plies 26, 28 isolate means 30 from moisture and air, the two ingredients causing rust; 2) upper ply 26 provides a compliant surface for attaching a rail plate and for rail fasteners and further provides noise and vibration isolation, as well as reducing impact loading to tie 20 from rail loading; 3) ply 28 provides a lower compliant pad for interacting with bed ballast positioned there beneath to resist lateral movement induced by side wheel load, on curves, for example. Even though rubber has a higher coefficient of thermal expansion than wood, railroad tie 20 maintains rail gauge during temperature extremes better than wood ties. That is because the metal reinforcing means 30 has a significantly lower coefficient of thermal expansion than wood and, with the rubber ply 26 being bonded to the metal, the coefficient of the metal dominates.

Figure 6B:
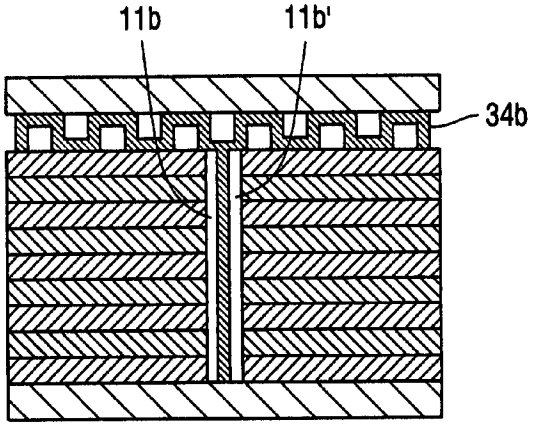
FIG. 6B is an end view of the railroad tie depicting a third embodiment of stiffener.
Figure 6D:
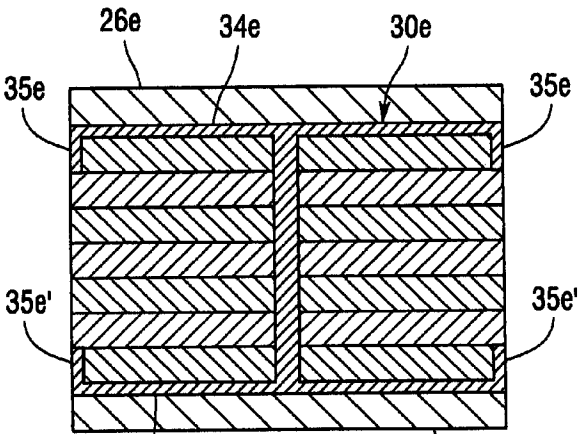
FIG. 6D is an end view of the railroad tie depicting a fifth embodiment of stiffener.
Figure 6A:
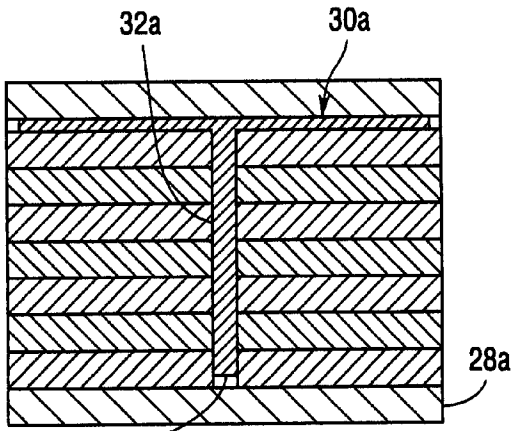
FIG. 6A is an end view of the railroad tie depicting a second embodiment of stiffener.

As seen in FIG. 5, reinforcing means 30 preferably takes the form of an I-beam. However, as can be seen in FIGS. 6A, 6B, 6C, 6D, 7A, and 7B, reinforcing means 30 can take a variety of forms. The reinforcing means 30*a* of FIG. 6A is T-shaped with the distal end 33*a* of vertical portion 32*a* being spaced from lower ply 28*a* to provide a compression gap and thereby reduce/eliminate deterioration of ply 28*a* by penetration by distal end 33*a*. Should additional torsional and/or bending stiffness be needed, the lateral reinforcing member 34*b* can be corrugated as depicted in FIG. 6B. Another feature depicted there is the creation of spaces 11*b* and 11*b'* between the edges of stacks 24*b* and the vertical portion 32*b* to provide electrical isolation. Should the air gap prove inadequate to produce the desired isolation, the gaps 11*b*, 11*b'* can be filled with a non-conductive, non-abrasive material such as tire treads, plastic liners, coatings, etc. Obviously, a second lower corrugated flange could also be provided to further increase torsional and bending stiffness.

Figure 6C:
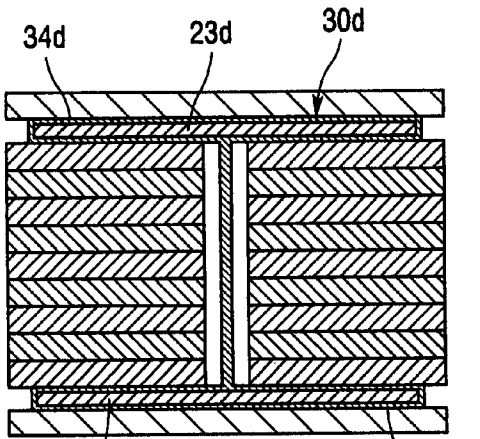
FIG. 6C is an end view of the railroad tie depicting a fourth embodiment of stiffener.

FIG. 6C depicts a fourth embodiment of stiffener 30*d* in which the lateral flanges 34*d*, 34*d'* are hollow box beams which are filled with a layer of tire tread 23*d*, 23*d'*. FIG. 6D shows a fifth embodiment of the stiffener 30*e* in which each distal end of horizontal flanges 34*e* and 34*e'* is further reinforced by a transverse flange 35*e*, 35*e'* extending orthogonally to its respective horizontal flange 34*e*, 34*e'* and parallel to vertical flange 32*e*. While each transverse flange 35*e*, 35*e'* is shown projecting inwardly, it will be appreciated that each flange might very well extend outwardly. An additional benefit to such a configuration is that upper and lower plies 26*e* and 28*e* are protected during handling from partial de-lamination which occasionally occurs from handling by cherry pickers, forklifts, and the like.

Figure 7B:
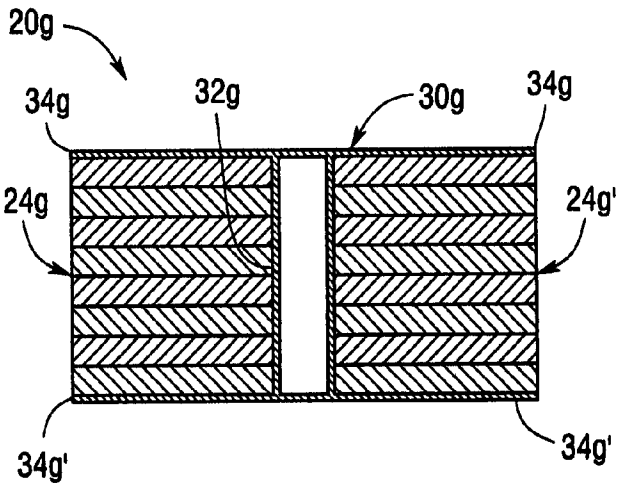
FIG. 7B is an end view of the railroad tie depicting a seventh embodiment of stiffener.
Figure 7A:
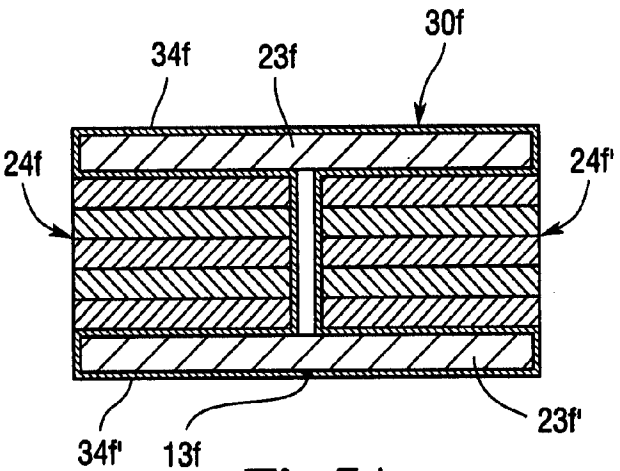
FIG. 7A is an end view of the railroad tie depicting a sixth embodiment of stiffener.

FIG. 7A discloses a sixth embodiment of the reinforcing means 30*f*. In this embodiment, the I-beam shaped member 30*f* is formed by folding a single piece of metal, such as steel, which may be welded as at 13*f* or a space may be left between the ends to permit additional flexing by tie 20*f*. As with the earlier embodiments, the two stacks of treads 24*f*, 24*f'* are positioned between the flanges 34*f*, 34*f'* with plies 23*f*, 23*f'* positioned in the open boxes formed by the folded sheet steel. Capping plies may be utilized if the application requires.

FIG. 7B shows a seventh embodiment of reinforcing means 30*g* in which the open box beam is the vertical portion 32*g*. The width of the box created by vertical portion 32*g* can be adjusted to provide the desired dimension of the railroad tie 20*g* with the two stacks 24*g*, 24*g'* being positioned between flanges 34*g* and 34*g'*. Again, capping treads may be provided as necessary.

Figure 8:
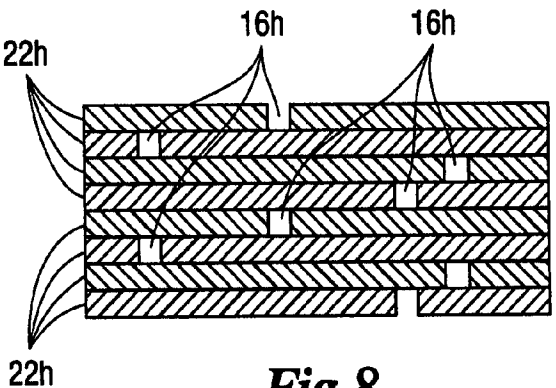
FIG. 8 is a side view of the railroad tie laminations depicting isolation gaps.

FIG. 8 shows a layup technique for plies 22*h*. While it is preferred that each ply length be a minimum of 12 inches, lengths are spaced by distances of between 0.25-0.50 inch forming gaps 16*h* to provide electrical isolation. As has been noted, the bulk of tires being recycled into the rail tie 20 of the present invention are steel belted. For applications where the rails are being used to transmit electrical signals, data, etc., it is essential that rails 12, 12' be isolated from each other. This spacing technique with ensure that the steel belts do not short out between rails 12, 12'. Capping treads used for this application will be polyester-belted tires.

Returning to the preferred embodiment of FIGS. 1-5, it can be seen that flanges 34, 34' have spaced openings 36 in each. These openings are wide enough to accommodate rail spikes 14 and long enough to permit some adjustment of their positioning. Both flanges 34, 34' are provided with such openings 36 in order to make the tie 20 non-directional, i.e., either surface can be utilized as the top surface. The openings do not extend into either the stacked plies 22 or the capping plies 26, 28 in order to maximize the gripping force of those plies in retaining the spikes 14 against backout. It is anticipated that the capping plies 26, 28 will have the position of openings 36 there beneath indicated by painting/etching on the surface to facilitate the insertion of spikes 14.

Figure 9B:
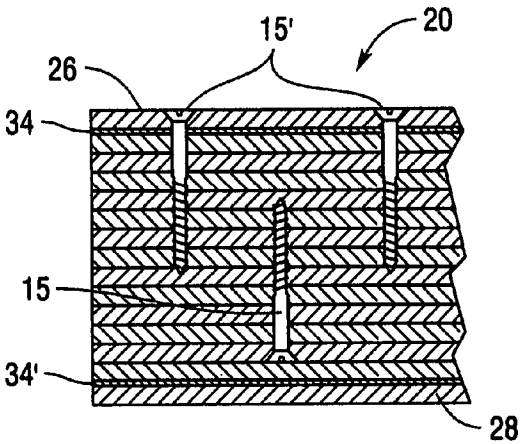
FIG. 9B is a cross-sectional side view as seen along line 9B-9B in FIG. 9A.
Figure 9A:
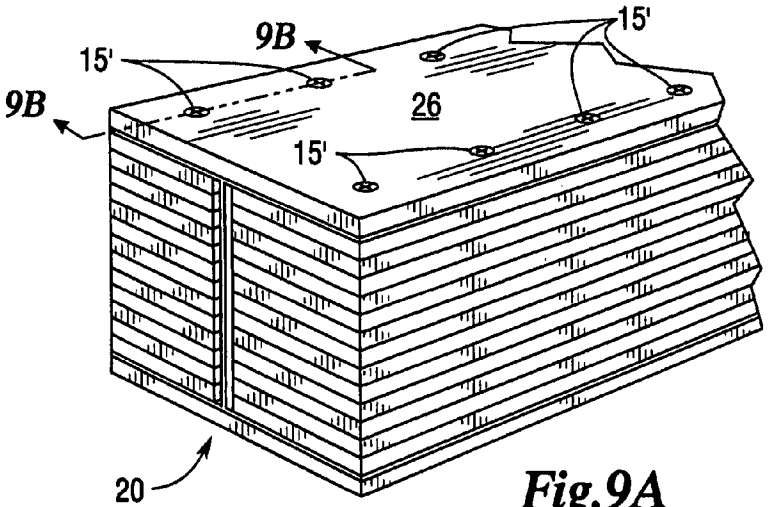
FIG. 9A is partial perspective view of the railroad tie in a ninth embodiment.

As seen in FIGS. 9A and 9B, lag screws 15 can be utilized to connect plies 22 together in a stack 24. Indeed, lag screws 15' can be threaded through cap ply 26 and flange 34 into plies 22. Obviously, screws 15' could also be used to attach cap ply 28 to the lower side, since it is preferred that the tie 20 not have a distinctive top and bottom. Lag screws 15, 15' can be used in addition to or in lieu of the bonding epoxy noted earlier.

Figure 10:
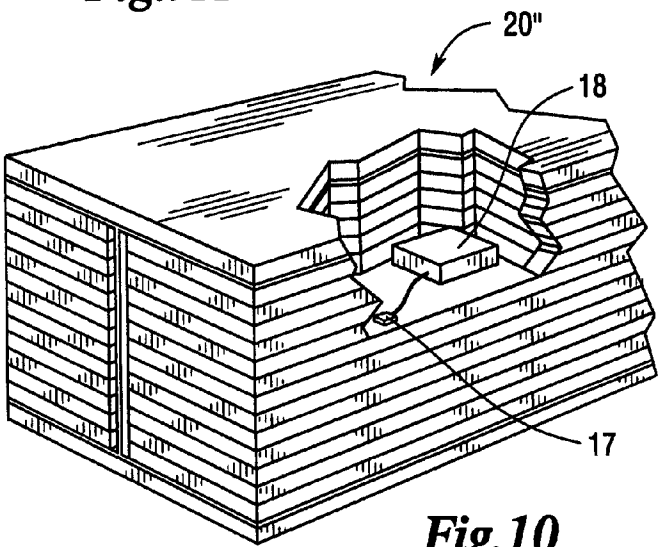
FIG. 10 is a partial perspective view of a tenth embodiment of the railroad tie with portions broken away.

FIG. 10 shows a specialty tie having incorporated in the body of tie 20" a sensor 17 and a black box 18 embedded between plies 22. Black box 18 might contain a receiver/transmitter (a transponder) and data analysis circuitry. Such a specialty tie 20" can be positioned periodically through out the rail bed to monitor the integrity of the rails and/or the bed. Such sensor circuitry could give early warning of loosening spikes.

The railroad tie 20 of the present invention has a number of advantages over conventional creosote-coated wood ties. All the materials utilized in manufacture of tie 20 are environmentally friendly and entirely recyclable. The rail plate commonly used with other types of ties, could be integrated with the spine 30. Specialty fasteners could also be integrated into spine 30. The cost of the tie is a linear function of the length, whereas lengthening conventional ties can increase cost exponentially. The stiffness of tie 20 can be varied to match other ties to enable its use in replacing worn ties without materially altering the nature of the bed. Spine 30 results in a "no creep" tie, unlike other rail ties. Additional characteristics of the tie 20 could be altered by providing a protective coating for the exterior of the tie to enhance its weatherability. In addition, the sides of tie 20 could be textured to enhance adhesion of the tie to the ballast. The tie 20 of the present invention is considerably lighter weight, making them more maneuverable, without any sacrifice in strength. Additional weight and material cost could be saved by reducing the length of the tire stacks 24, 24' to only extend under the portion of flanges 34, 34' which support rails 12, 12'. The flanges 34, 34' do not have to be full width throughout the length of the tie 20.

Various changes, alternatives and modifications will become apparent to one of ordinary skill in the art following a reading of the foregoing specification. For example, the pre-drilled holes in the flanges of the reinforcing means can be omitted and the holes drilled on site or special fasteners employed such as lag bolts or clips which have a retainer which attaches to the flange. It is intended that any such changes, alternatives and modifications as fall within the scope of the appended claims be considered part of the present invention.

We claim:

1. A rail tie, comprising:

at least two stacks of laminated tire treads;

a reinforcing member comprising an I-beam having a vertical member disposed between said at least two stacks of laminated tire treads, and at least two reinforcing flanges, the first reinforcing flange extending from a first end of said vertical member and the second reinforcing flange extending from another end of said vertical member; and at least two one-half width stack of tire treads, each of the one-half width stacks disposed between the reinforcing flanges, wherein said I-beam has upper and lower box flanges which are each filled with tire treads.

2. A rail tie, comprising:

at least two stacks of laminated tire treads; and a reinforcing member having a vertical member disposed between said at least two stacks of laminated tire treads, and at least two reinforcing flanges, the first reinforcing flange extending from a first end of said vertical member and the second reinforcing flange extending from another end of said vertical member, wherein said reinforcing member comprises an I-beam having a hollow box spine.

3. A rail tie, comprising:

at least one stack of laminated tire treads forming a body of said rail tie;

reinforcing means integrated into said at least one stack of laminated tire treads, said reinforcing means having a first portion providing increased compressive strength and a second portion providing increased torsional and bending stiffness to said rail tie; and electronic sensor means and signaling means embedded in said at least one stack of laminated tire treads.

4. A rail tie, comprising:

at least two stacks of laminated tire treads forming a body of said rail tie; and reinforcing means integrated into said at least two stacks of laminated tire treads, said reinforcing means having a first portion providing increased compressive strength and a second portion providing increased torsional and bending stiffness to said rail tie, wherein said reinforcing means includes a vertical member extending between said at least two stacks of laminated tire treads, said reinforcing means further comprising at least one horizontally extending flange connected to said vertical member, and at least one reinforcing flange comprising a corrugated flange which extends in both directions from a top end of said vertical member.

5. A rail tie, comprising:

at least two stacks of laminated tire treads forming a body of said rail tie;

reinforcing means integrated into said at least two stacks of laminated tire treads, said reinforcing means having a first portion providing increased compressive strength and a second portion providing increased torsional and bending stiffness to said rail tie, wherein said reinforcing means includes a vertical member extending between said at least two stacks of laminated tire treads in non-contacting relationship to provide electrical isolation, wherein a gap is formed in each layer in said at least two stacks of laminated tire treads, and wherein said tire treads are comprised of recycled steel belted tires.

* * * * *